United States Patent [19]

Nozaki et al.

[11] Patent Number: 4,463,672

[45] **Date of Patent: * Aug. 7, 1984**

[54] PRINTING APPARATUS HAVING STAIN PREVENTING MEANS

[75] Inventors: Mineo Nozaki, Kawasaki; Toshiaki Ozawa; Osamu Asakura, both of Tokyo; Hiroatsu Kondo, Zushi; Shigeru Okamura, Yokohama, all of Japan

[73] Assignee: Canon Kabushiki Kaisha, Tokyo, Japan

[ * ] Notice: The portion of the term of this patent subsequent to Feb. 17, 1998 has been disclaimed.

[21] Appl. No.: 382,193

[22] Filed: May 26, 1982

Related U.S. Application Data

[63] Continuation of Ser. No. 136,773, Apr. 3, 1980, abandoned, which is a continuation of Ser. No. 923,730, Jul. 11, 1978, abandoned.

[30] Foreign Application Priority Data

| | | | |
|---|---|---|---|
| Jul. 11, 1977 | [JP] | Japan | 52-82731 |
| Jul. 11, 1977 | [JP] | Japan | 52-82732 |
| Jul. 18, 1977 | [JP] | Japan | 52-85840 |
| Jul. 18, 1977 | [JP] | Japan | 52-85841 |

[51] Int. Cl.[3] ..... B41J 9/12

[52] U.S. Cl. ..... 101/93.09; 101/110; 101/416 R

[58] Field of Search .... 101/93.09, 93.14, 93.29–93.34, 101/93.48, 93.16, 93.17, 93.21, 93.5, 110, 112, 416 R, 416 A, 420; 400/154, 247, 248, 508

[56] References Cited

U.S. PATENT DOCUMENTS

| | | | |
|---|---|---|---|
| Re. 28,796 | 5/1973 | Shimodaira et al. | 101/93.31 |
| 1,025,137 | 5/1912 | Hessan | 101/206 |
| 3,332,343 | 7/1967 | Sims | 101/93.09 X |
| 3,677,452 | 7/1970 | Wallace | 400/568 X |
| 3,734,012 | 5/1973 | Haggins | 101/93.16 |
| 3,750,794 | 8/1973 | Griggs | 101/93.23 X |
| 3,797,387 | 3/1975 | Decker et al. | 101/93.09 |
| 3,805,696 | 4/1975 | Tsuji | 101/110 |
| 3,994,219 | 11/1976 | Yasuda et al. | 101/93.09 |
| 4,054,089 | 10/1977 | Okabe | 101/110 |
| 4,070,963 | 1/1978 | Weaver | 101/93.29 |
| 4,110,050 | 8/1978 | Wood et al. | 400/248 |
| 4,240,345 | 12/1980 | Kyoguko | 101/205 |
| 4,250,807 | 2/1981 | Kordo et al. | 101/93.09 |

FOREIGN PATENT DOCUMENTS

| | | | |
|---|---|---|---|
| 2521720 | 11/1975 | Fed. Rep. of Germany | 101/93.09 |

*Primary Examiner*—Edward M. Coven

*Attorney, Agent, or Firm*—Fitzpatrick, Cella, Harper & Scinto

[57] ABSTRACT

The apparatus of the present invention is provided with a stain preventing element provided between a print drum and a hammer and adapted to shield alternate digits to be printed, said stain preventing element being shiftable in the transverse or advancing direction of print sheet. Said hammer is an intermediate hammer which is set to a predetermined initial position from an unsteady position upon the turning on of the power supply, and simultaneously necessary preparations such as paper feeding and ink application onto the print drum prior to the printing are performed. Also there is provided a stain preventing mechanism for multi-color printing, and the above-mentioned stain preventing member is provided with a means for preventing ink diffusion. Also the paper feed plunger etc. is structured similar to the said hammer thereby rendering the entire apparatus smaller and more compact.

14 Claims, 25 Drawing Figures

PRINTING APPARATUS HAVING STAIN PREVENTING MEANS

This is a continuation of application Ser. No. 136,773, filed Apr. 3, 1980, now abandoned, which in turn is a continuation of Appln. Ser. No. 923,730, filed July 11, 1978, now abandoned.

BACKGROUND OF THE INVENTION

1. Field of the Invention

The present invention relates to a printing apparatus for computer and the like, and more particularly to a printing apparatus utilizing an impact hammer as a printing means.

2. Description of the Prior Art

In printing apparatus utilizing a conventional ink roller, as shown in FIGS. 1 and 2, the printing operation of the hammer 3 is apt to cause the vibration of paper 4 in an extended area, thus eventually causing ink stain in other digit positions since the ink is applied by the ink roller 1 to the type faces of print drum 2. In order to prevent this drawback there is provided a stain preventing member 5 or 5', which is extended, as shown in the drawings, into all the spaces between two adjacent digits. In such arrangement, in order that the paper 4 is pushed beyond said stain preventing member 5, 5' to receive the ink from the print drum 2, the hammer 3 has to exert a strong pressure so as to bring said paper 4 into contact with the type face on the print drum 2, thus requiring an elevated level of printing energy and inevitably generating increased noise. Also the inevitable fluctuation in the distance from the stain preventing member 5, 5' to the surface of drum 2 has resulted in uneven print density for different digits or eventually in incomplete printing where a portion of a type face is not printable.

Such drawbacks are not solvable by merely improving the precision of the component parts, and have been a serious problem in maintaining the print quality particularly in consideration of the wear of the stain preventing member, drum, bearing etc. in the use.

In consideration of the drawbacks in the conventional apparatus, the present invention intends to provide a constant print quality even with a reduced print energy by maintaining constant the distance from the stain preventing member to the print drum.

SUMMARY OF THE INVENTION

The object of the present invention is to provide a printing apparatus capable of preventing stain on the print sheet by means of a simple mechanism.

An another object of the present invention is to provide a printing apparatus functioning with a reduced printing energy thereby reducing the printing and other noises.

Still another object of the present invention is to provide a printing apparatus capable of stabilizing the printing condition thereby providing an improved print quality.

Other objects of the present invention will be made clear from the following description of the embodiments thereof to be made with reference to the attached drawings.

DESCRIPTION OF THE PREFERRED EMBODIMENTS

Figure 3:
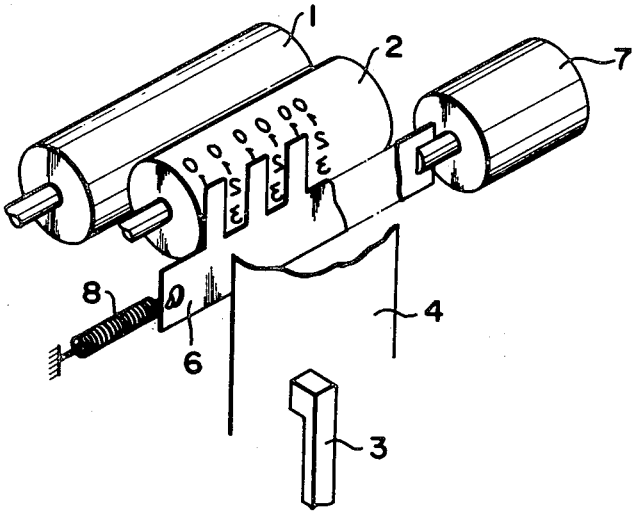
FIG. 3 is a view of an embodiment of the stain preventing member of the present invention.

According to the present invention, as shown in FIG. 3, the ink is applied by the ink roller 1 to the print drum 2, while between said print drum 2 and paper 4 there is provided a stain preventing member 6 structured to shield the type faces of alternate digits. After the printing operation by the exposed digits of drum 2, said stain preventing member 6 is shifted by one digit by means of a shift mechanism composed of a plunger 7 and a spring 8 thereby exposing the digits thus far shielded to perform the printing thereof.

Figure 1:
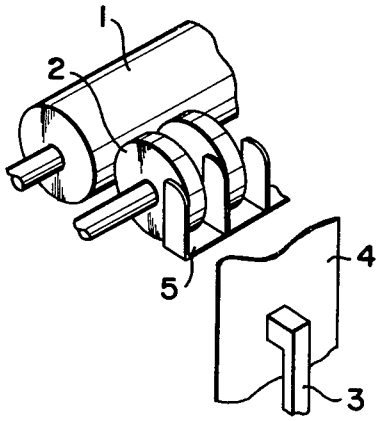
FIG. 1 PRIOR ART
FIGS. 1 and 2 are views of conventional stain preventing members.
Figure 2:
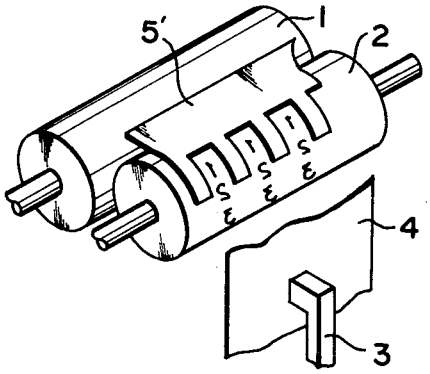
FIG. 2 PRIOR ART
Figure 4A:
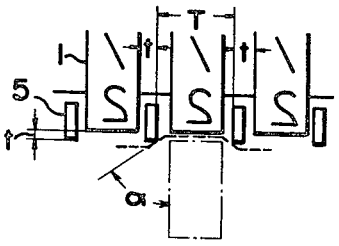
FIG.4A PRIOR ART
FIG. 4A is a partially enlarged plan view of the conventional printing device shown in FIG. 1.
Figure 4B:
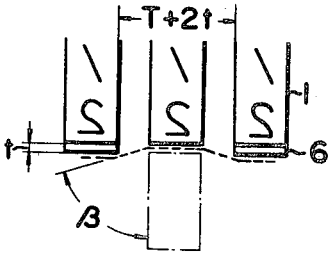
FIG. 4B is a partially enlarged plan view of the printing device according to the present invention shown in FIG. 3.
Figure 5A:
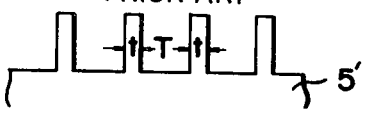
FIG.5A PRIOR ART
FIG. 5A is an elevational view of the conventional stain preventing member shown in FIG. 2.
Figure 5B:
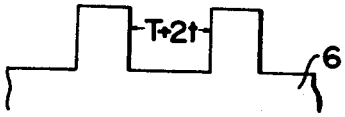
FIG. 5B is an elevational view of the stain preventing member according to the present invention shown in FIG. 3.
Figure 6:
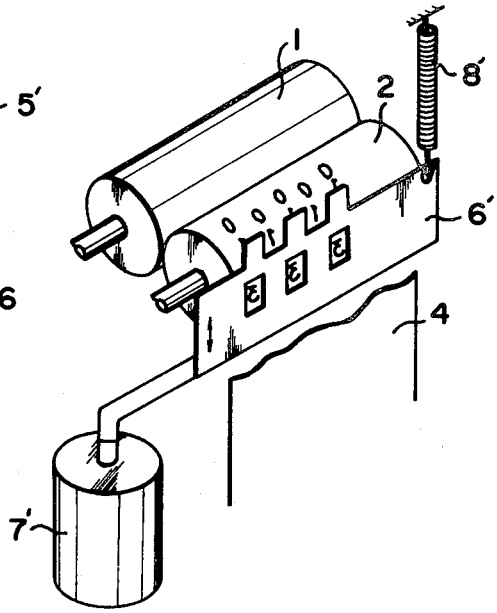
FIG. 6 is a view showing an another embodiment of the present invention.

Said stain preventing member 6 is composed of a thin metal or plastic plate (0.1 to 0.3 mm in thickness) and is rendered flexible so as to come into contact with the print drum 2 at the printing operation thereby reducing the bending force applied onto the paper 4. Also the print hammer 3 is driven with a reduced driving force. Referring to FIG. 4A showing the apparatus of FIG. 1 seen from the above, the width of flexion of paper is defined by T, while in the apparatus of the present invention shown in FIG. 4B said width can be increased to $T+2t$ with the corresponding flexion angle of paper being made blunter from $\alpha$ to $\beta$, so that a satisfactory printing can be achieved even with a smaller driving force of the hammer 3. Also FIGS. 5A and 5B show the possibility of a wider notch in the present invention than in the conventional apparatus shown in FIG. 2. This effect is achieved by a fact that the member 6 is positioned on certain digits and does not require particular space therefor. In FIG. 6 the stain preventing member 6' is modified from the member 6 shown in FIG. 3 in that it is rendered shiftable in the paper advancing direction, and it will be readily understood that the printing of every digit is still possible also in this arrangement. In these embodiments it will also be apparent that the function of shift mechanism represented by the plunger 7, 7' and spring 7'', 8, 8' can be replaced, for example, by a combination of the rotating force of drum drive motor and a cam, or by a link mechanism. Also it is possible to render said stain preventing member 6, 6' stationary while shifting said print drum 2 by one digit by means of said shift mechanism.

Figure 7:
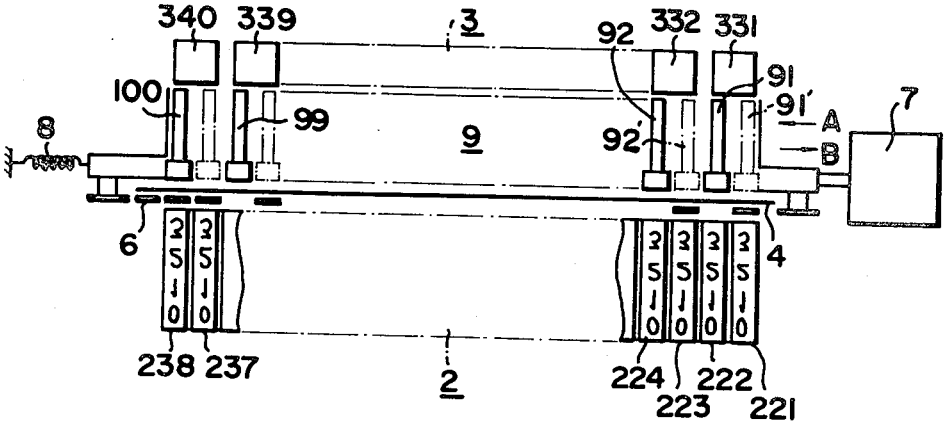
FIG. 7 is a view showing a still another embodiment modified from that shown in FIG. 3.

In the embodiment shown in FIG. 7, the shift mechanism composed of said plunger 7 and spring 8 is so structured as to shift, in combination, the stain preventing member 6 of the present invention and the intermediate hammers 9 located in the non-shielded digits. Such arrangement is greatly advantageous in that it is not only unnecessary to provide the hammers to all the digits but also possible to achieve correct positioning of the hammers 9 and the stain preventing member 6 in the shift direction and to prevent erroneous operation or mechanical damage in case the stain preventing member 6 is erroneously shifted during the hammer operation.

In the printing operation of the apparatus shown in FIG. 7, the intermediate hammers 9 are at first shifted to the direction A for the initial state setting upon feeding of the print paper 4.

The main hammers 331–340 are biased toward the print drum 2 when desired type faces on said drum 2 reach predetermined positions thereby driving the intermediate hammers 91–100 into contact with the type wheels 222, 224, . . . , 232 thereby performing printing on the paper 4.

In this state the printing obtained on the paper 4 is not all the digits but every other digit.

Successively the intermediate hammers 9 are shifted in the direction B by one digit so as to bring, for example, the intermediate hammer 91 to a position 91', and again driven by the main hammers 331–340 to print the digits placed between the already printed digits. Upon successive paper feeding, the intermediate hammers 9 are returned to the direction A by means of the spring 8, thus completing the operation for the printing of one line.

Figure 8:
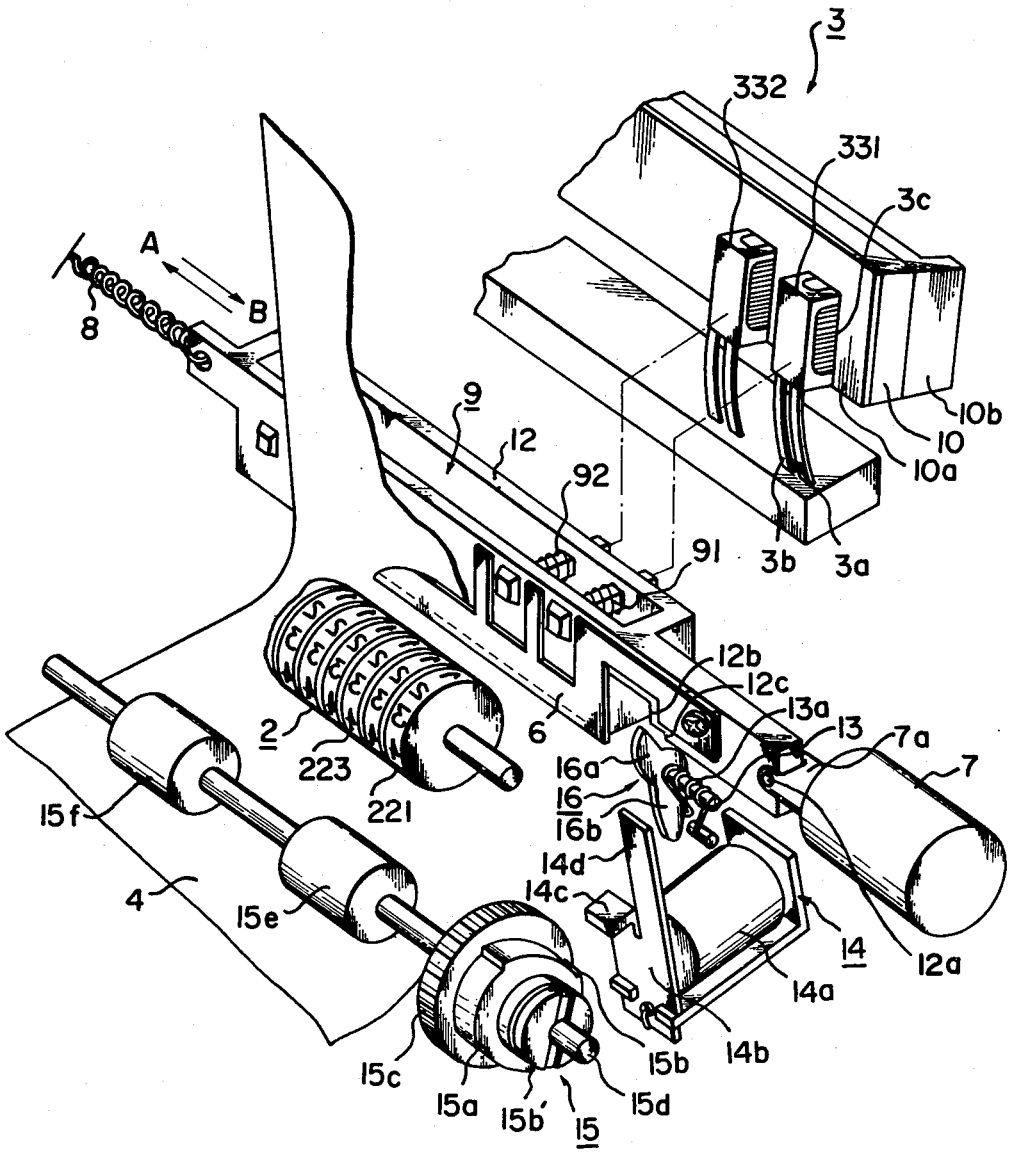
FIG. 8 is a detailed view of FIG. 7.

In FIG. 8 showing the details of said shift mechanism for said intermediate hammers 9, there are shown a holder 12 for holding said intermediate hammers 9, a plunger 14 for triggering the paper feed, a spring clutch 15 for transmitting the rotation of a gear **15*c* to a shift 15*d*, and a positioning lever 16 for the holder 12**.

Upon turning on of the power supply to the printer, a print drum drive motor (not shown) is started to initiate the idle rotation of gear **15*c* and the ink application by the ink roller 1 onto the print drum thereby preparing for the printing. Upon successive energization of a coil 14*a* of the plunger 14 for triggering paper feed, a claw 14*c* of an armature 14*b* thereof is released from the teeth 15*b* of a ratchet 15*a* of said spring clutch 15 to allow said ratchet to perform a rotation for a predetermined angle until a next tooth 15*b'* becomes engaged with said claw 14*c***.

By said rotation of ratchet **15*a* the rotation of gear 15*c* is transmitted to the shaft 15*d* thereby feeding paper by means of rubber rollers 15*e*, 15*f*** fixed on said shaft.

The armature **14*b* is also provided with an another claw 14*d* which presses, simultaneously with said paper feeding, an end 16*b* of the positioning lever 16 anticlockwise about an axis 13 thereof to release a claw 16*a* of said lever 16 from an end face 12*b* of the holder 12. Thus the holder 12 is shifted in the direction of arrow A until an end face 12*c* comes into contact with the claw 16*a***, thus reaching a position for starting print.

Said holder is often shifted to an unidentified position or inadvertently moved manually when the power supply is cut off. It is therefore extremely desirable, upon turning on of the power supply, to automatically set the initial position of said holder as well as the paper feeding and ink application onto the print drum prior to the start of printing operation.

Now the printing of digits in even places is performed by driving the intermediate hammers 9 by means of a print signal.

Successively the holder shift plunger 7 is energized to attract the armature **7*a* maintained in engagement with the holder 12 thereby shifting the same to the direction of arrow B. The positioning lever 16, being biased with a clockwise torgue about the axis 13 by means of the spring 13*a*, becomes inserted along the end face 12*b* upon shifting of the holder 12 to maintain said holder 12** in this position. Successively the printing of digits in odd places is performed by a print signal.

Upon completion of printing the paper feed coil **14*a* is energized to perform paper feeding in the aforementioned manner and to release the claw 16*a* of positioning lever 16 from the end face 12*b* whereby the holder 12 is shifted in the direction of arrow A by means of spring 8 to return to the initial state and to await the next print instruction. Main hammers 3 are for example composed of solenoids 3*c* each containing an iron core and a coil and each supported by springs 3*a*, 3*b*, said iron core being normally attracted by a permanent magnet 10 to accumulate a resilient force in said spring 3*a* and 3*b*. Upon energization of said solenoid 3*c* through the springs 3*a*, 3*b*** in this state, the hammer is released from said magnet to hit the intermediate hammer. Such arrangement is detailedly disclosed for example in the U.S. Pat. No. 4,044,455.

As explained in the foregoing, the use of a stain preventing member capable of shielding every other digit according to the present invention enables satisfactory printing even with a reduced printing energy, allows exact positioning of paper and print drum regardless of the precision or wear of component parts, as well as elevated print quality with a constant density and with a reduced printing noise.

Also the use of a shift mechanism for shifting the hammers in combination with the stain preventing member as shown in FIGS. 7 and 8 not only reduces the number of hammers into half but also reduces the instantaneous power consumption and the manufacturing cost and allows exact printing.

The aforementioned system of utilizing a stain preventing member capable of shielding every other digit and reciprocatingly shifting said member by a pitch between the neighboring digits for printing a line is advantageous in that it allows reduction of the pitch between the digits and to easy resolution of the problem of stain prevention. This system, however, still causes inadvertent adhesion of ink of the non-shielded digits to the paper in case of a multi-color printing apparatus utilizing ink rollers for different colors. In the following embodiments of the present invention, the above-mentioned drawback is avoided by providing a stain preventing belt in the boundary between the digits utilizing different inks.

Figure 9:
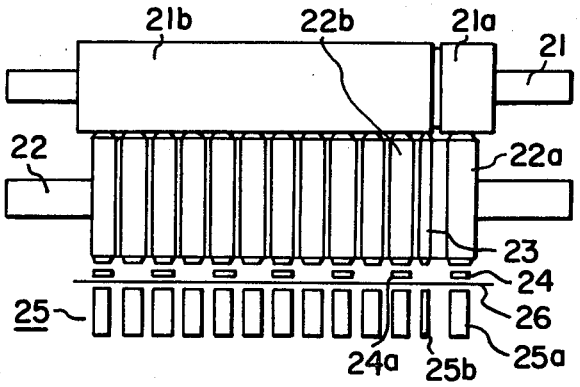
FIG. 9 is a planar view of a still another embodiment of the present invention.

In FIG. 9, 21 is an ink roller shaft provided thereon with ink rollers 21*a*, 21*b* of two colors. 22 is a print wheel shaft of which type face 22*a* receives for example a red ink in contact with the ink roller 21*a* while the type font 22*b* receives for example a black ink in contact with the ink roller 21*b*. There are provided hammers 25 to print the type faces of the digits not shielded by a stain preventing member 24 onto a paper 26.

Figure 10:
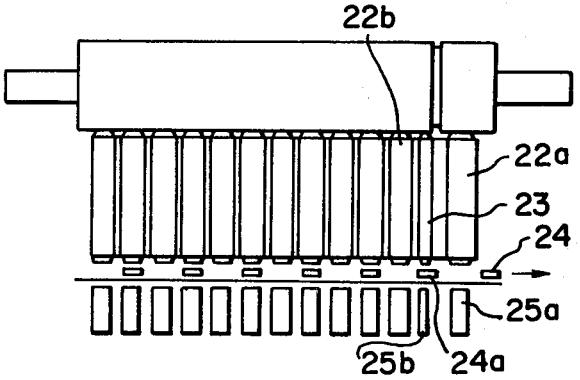
FIG. 10 is a view showing a state wherein the stain preventing member is shifted to the right by one digit.
Figure 11:
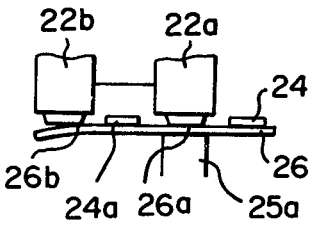
FIG. 11 PRIOR ART
FIG. 11 is a view of a conventional example.
Figure 12:
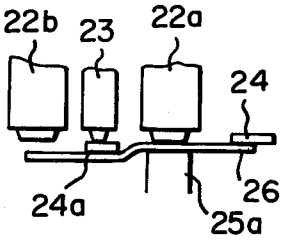
FIG. 12 is an enlarged partial view of an embodiment of the present invention.

Successively said stain preventing member 24 is shifted in the direction of arrow as shown in FIG. 10 to expose the digits previously covered by said member 24 and the hammers 25 are again actuated to complete the printing of one line. In this case, if the type or print faces or wheels 22*a* and 22*b* are simply separated by a groove as shown in FIG. 11, the printing operation by the hammer 25*a* hitting the type face 22*a* through the portion 26*a* of paper 26 may cause inadvertent deposition of ink from the type face 22*b* onto the portion 26*b* of paper 26 to form stain since the stain preventing member 24*a* is already displaced from said type face 22*b* and the distance between the type faces 22*a* and 22*b* is particularly large. In order to prevent such stain there is provided, between the type wheels 22*a* and 22*b* as shown in FIGS. 9, 10 and 12, a stain preventing belt 23 which is provided at an approximately same level as the type faces 22*a*, 22*b* and is of a small width so as to come only in contact with the ink roller 21*b*.

Such arrangement is advantageous in that it is capable of preventing inadvertent stain of paper 26 and it is inexpensive since said stain preventing belt can be formed integrally with ordinary print wheels 22*a*, 22*b*. Further it is possible to increase the number of printable digits by one digit if said belt is provided with smaller type faces for example of special print marks and a hammer 25*b* is correspondingly provided. It will be easily understood that said hammer 25*b* can be of a same size as the hammer 25*a*. Although ordinary ink rollers are designed so as not to use the end portion thereof, no difficulty arises in the use of such end portion in case of smaller type faces as in the present embodiment.

Still another embodiment of the present invention relates to a printing apparatus wherein the stain preventing member is provided with an ink diffusion preventing mechanism to prevent stain on the print paper and to reduce the drive energy of print hammers.

Figure 13:
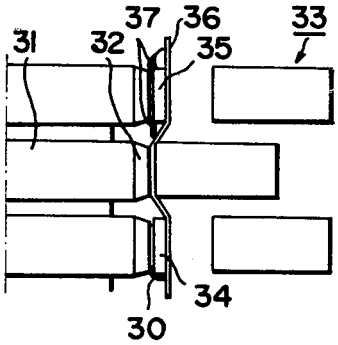
FIG. 13 PRIOR ART
FIGS. 13 and 14 are enlarged views of conventional apparatus.
Figure 14:
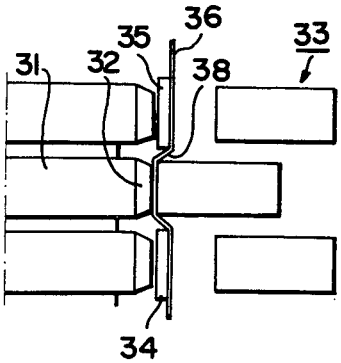
FIG. 14 PRIOR ART

As explained in the foregoing, the stain preventing member of the present invention is structured to shield every other digit and is displaced to shield even places in case of printing the digits in odd places and to shield odd places in case of printing the digits in even places thereby preventing eventual contact of unnecessary type faces with the paper. However, as shown in the enlarged drawing of FIG. 13 illustrating the printing state, as the stain preventing members 34, 35 being of a rectangular cross-section, the ink 30 applied onto the type face migrates to a surface facing thereto of the stain preventing member 34 and diffuses further to the side face thereof to cause stain on the paper 36. Also paper dust resulting from the paper 36 is deposited on the ink diffused on the stain preventing member 35, said dust in turn collecting ink, and this cycle being repeated until the ink-containing paper dust 37 is developed reaching the paper 36 as shown in the drawing. A larger width of stain preventing member 34, 35 as shown in FIG. 14 is effective for preventing the danger of such paper staining, but result in an increased printing energy as the paper 36 has to be subjected to a sharper flexion as represented by 38 at the printing operation.

Figure 15:
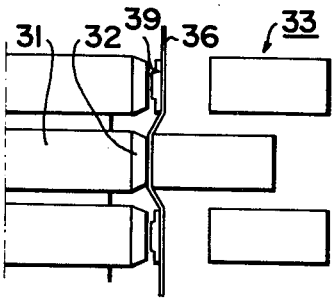
FIG. 15 is a view showing a still another embodiment of the present invention.

FIG. 15 shows a stain preventing member improved so as to prevent the above-mentioned drawback, wherein the stain preventing member 39 has a shoulder cross-section as illustrated whereby the width of said member coming into contact with the type face is smaller than that coming into contact with the paper. Such structure reduces the area of stain preventing member receiving the ink, thus reducing the diffusion of ink, and the eventually deposited ink is collected at the corner portion of shouldered structure and prevented from lateral flow. Likewise the deposition of paper dust is also prevented. It is further possible to structure the stain preventing member in such a manner that the contact width thereof is also reduced on the paper side.

As explained in the foregoing, this embodiment is highly effective for preventing the staining of print paper and also allows printing operation with a reduced printing energy.

Figure 16:
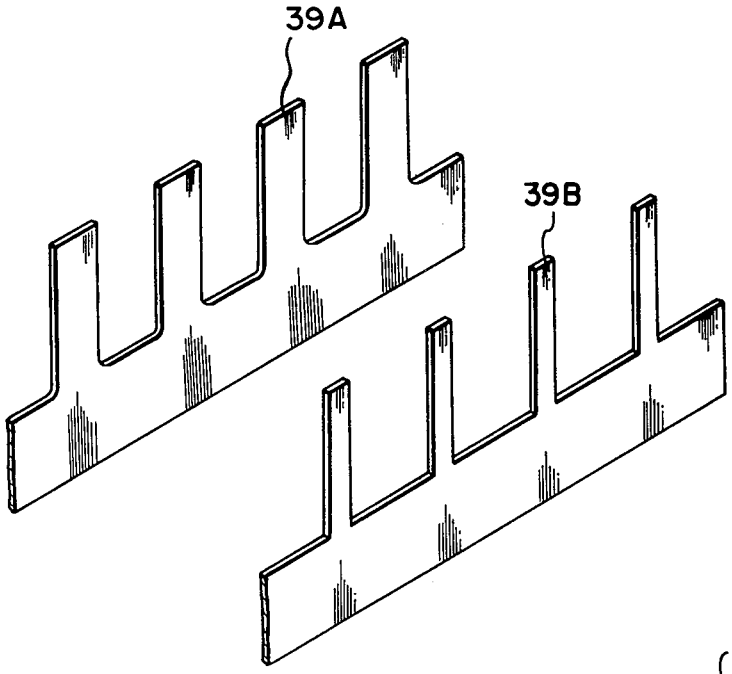
FIG. 16 is a view showing an example of the structure of the stain preventing member to be employed in the apparatus shown in FIG. 15.
Figure 17:
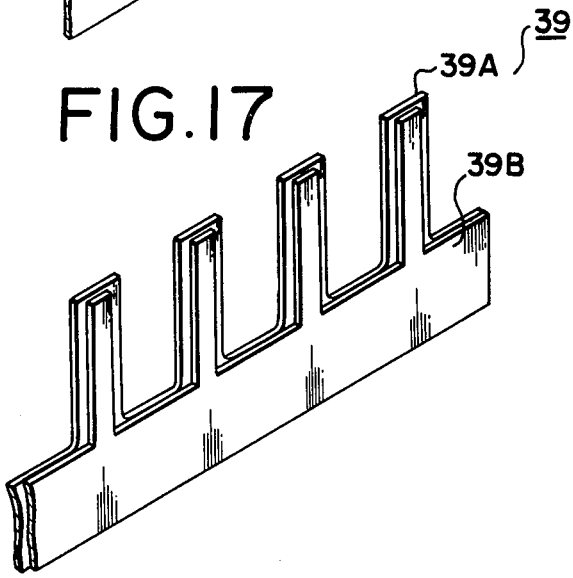
FIG. 17 is a view wherein the member of FIG. 16 is connected.

FIGS. 16 and 17 shows an example of preparing the stain preventing member 39 shown in FIG. 15. Said stain preventing member 39 provided with a shouldered cross section as shown in FIG. 17, can be easily obtained by superposing, as shown in FIG. 16, a member with wider masks 39A and an another member with narrower masks 39B. Further it will be apparent that a stain preventing member of a more complicated cross-sectional shape can be similarly obtained by superposing a larger number of masks.

Figure 18A:
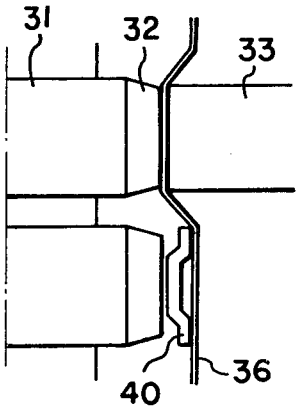
FIG. 18 is a view showing a still another embodiment of the present invention wherein (a) and (b) being respectively a planar and a perspective view thereof.
Figure 18B:
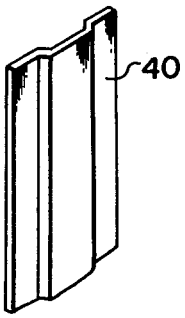

FIG. 18 shows a second example of the stain preventing member according to the present invention, wherein FIG. 18A is an enlarged view of the printing section. As shown in a perspective view of FIG. 18B, the stain preventing member 40 can be prepared by press drawing of a metal plate. As will be apparent from the drawing, this second example is capable of providing a stain preventing effect same as in the aforementioned first example.

As a third example, the stain preventing member can also be prepared by injection molding of a plastic material. The use of plastic material is preferable as it allows easy molding of a complicated structure.

Figure 19A:
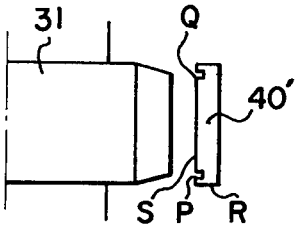
FIG. 19 is a view showing a still another embodiment of the present invention wherein (a) and (b) being respectively a planar view and a view seen from the type font side.
Figure 19B:
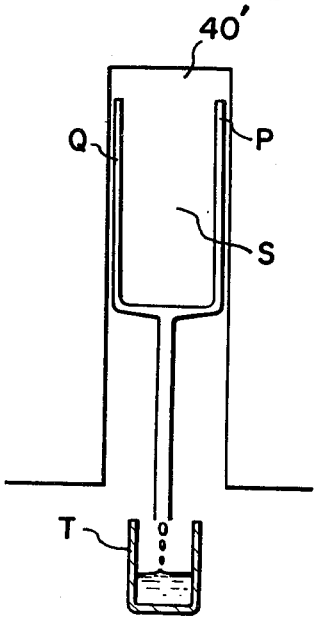

FIG. 19 shows a fourth example, in which the stain preventing member 40' is provided on the surface S thereof facing the type face with ink diffusion preventing grooves P and Q. The ink deposited from the type face is diffused on said surface S and enters said grooves P, Q. Even when the ink acculates to a certain amount, ink does not flow out to the side face R because of the surface tension thereof. It is further desirable, as shown in FIG. 19B, to extend said grooves P, Q to the lower end of the stain preventing member 40' and to provide an ink receiver T thereunder to receive the ink from said grooves P, Q. Further, as a fifth example, the stain preventing member can be coated on a surface thereof facing the type face with a material having no affinity with the ink. Examples of such material are olephobic materials such as fluorinated resin (for example Fricote 33, Fricote Co.) in case of the use of an oily ink, and hydrophobic materials such as silicon resin or oil in case of the use of an aqueous ink.

Figure 20:
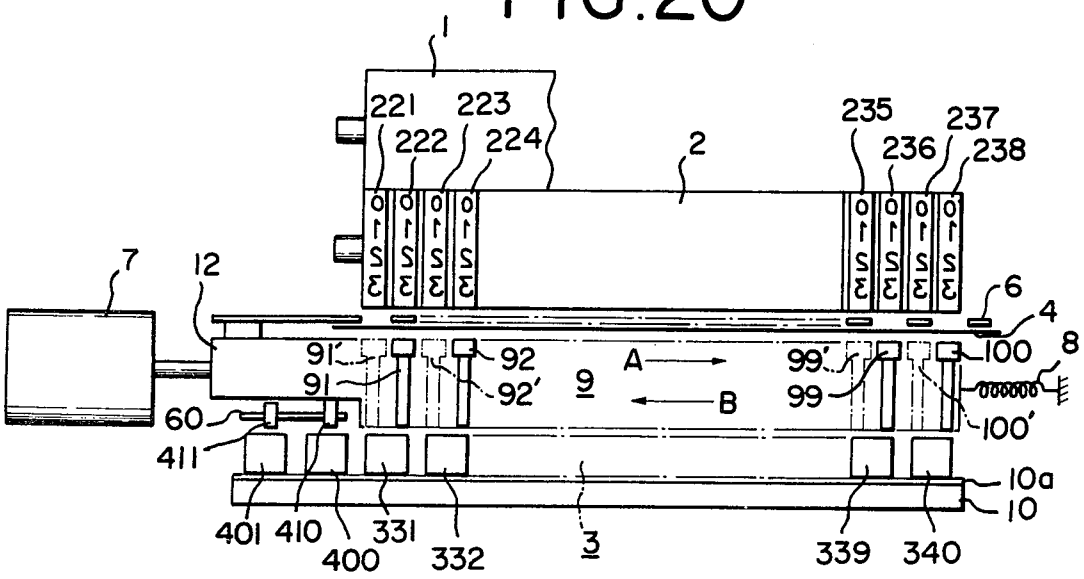
FIG. 20 is a planar view showing a still another embodiment of the present invention.
Figure 21:
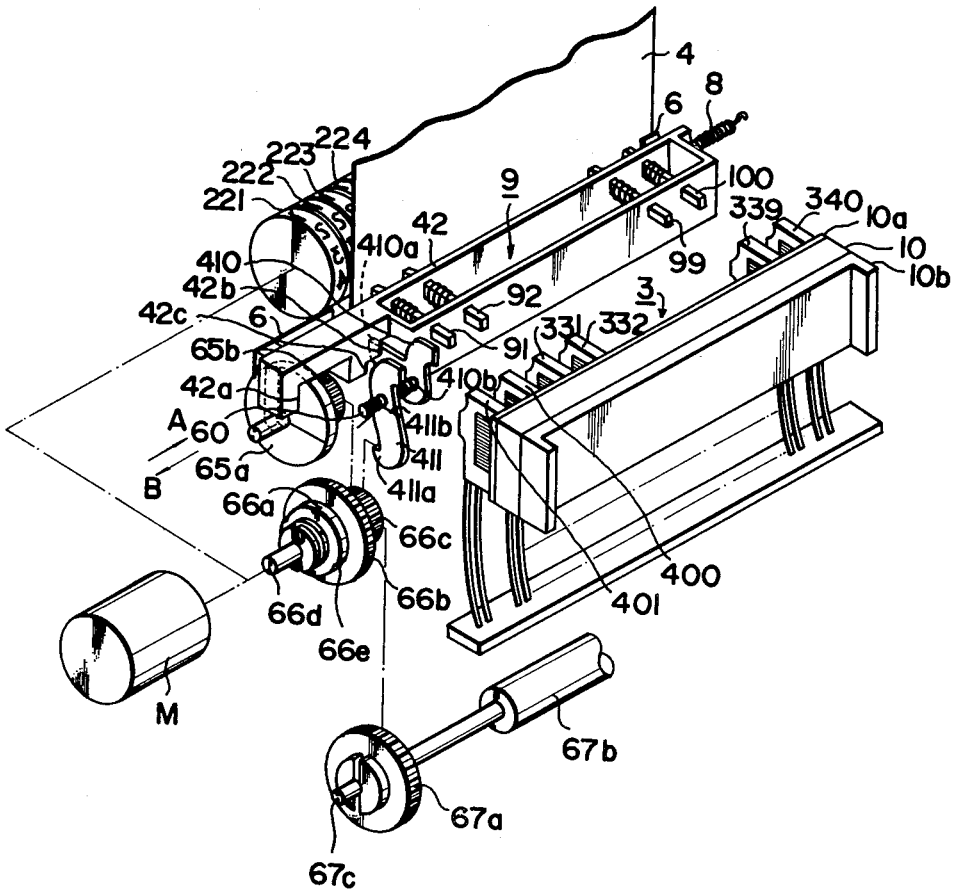
FIG. 21 is an exploded perspective view thereof.

FIGS. 20 and 21 show still another embodiment of the present invention wherein the mechanism is simplified by replacing the plunger 14 in FIG. 8 with electromagnet devices 400, 401, of a same structure as the hammers 331 and levers 410, 411 to be actuated by said electromagnets.

FIG. 21 shows an initial state before starting printing, wherein an intermediate hammer holder 42 is biased in the direction of arrow A by means of a spring 8 and is maintained in position by the end 410*a* of a lever 410 engaging with an end face 42*b* of said holder.

The main hammers 331–340 are selectively actuated by the print signals to select the type faces on the type wheels 221–238 through the intermediate hammers 9 thereby performing printing on the paper 4.

The hammer 400, upon successive energization thereof, rotates the lever 410 anticlockwise about an axis 60 whereby the end 410*a* of said lever 410 is released from the end face 42*b* of holder 42 which is therefore shifted until an end face 42*c* becomes engaged with the end 410*a* of lever 410. In this state the main hammers 331–340 are actuated by the print signals to drive the intermediate hammers 9 thereby performing printing on the paper in combination with the print wheels. Upon receipt of a succeeding paper feed signal, the hammer 401 is actuated to drive the lever 411 of which claw 411*a* is therefore released from the tooth 66*e* of a spring clutch 66*a*.

The spring clutch transmits the rotation of shaft 66*d* to the gears 66*b*, 66*c* until a next tooth comes into engagement with the claw 411*a* of the lever 411. Thus a gear 66*c*, engaging with a gear 67*a*, performs paper feeding through a shaft 67*c* and a rubber roller 67*b*.

Simultaneously the gear 66*c*, engaging with a gear 65*b*, transmits rotation to a cam 65*a* formed integrally therewith, said cam shifting the end face 42*a* of intermediate hammer holder 42 in the direction of arrow B. The lever 410, being anticlockwise biased by a spring 410*b*, enters a groove when the end face 42*b* passes the lever 410. Upon one rotation of cam when the cam face is lowered and released from the end face 42*a*, the intermediate hammer holder 42 is biased in the direction of arrow A by means of a spring 42*e* but is maintained in position by the lever 410 engaging with an end face 42*b*.

Thus the apparatus is returned to the initial state.

The present embodiment is featured by an extremely simple structure allowing mass production with a low cost, as the plunger explained in the foregoing is replaced by a mechanism similar to the printing hammer.

A further simplification in the structure is achieved by a fact that the drive force for paper feeding is obtained from the motor for driving the print drum. As explained in the foregoing, the stain preventing member 6 is constructed to shield every other digit and is shifted integrally with the holder 42 so that the paper 4 is subjected only to a small flexion angle which allows satisfactory printing even with a reduced driving force for hammers.

What we claim is:

1. A printing apparatus, comprising:

at least two ink rollers positioned apart from each other, each roller applying a different color ink;

a plurality of print wheels disposed on a shaft to received ink from said ink rollers, the print wheels which received one color ink from one ink roller being separated on the shaft by a space from the print wheels which received another color ink from another ink roller a stain preventing belt being disposed on the shaft in the space to prevent one color ink from transferring onto the print wheels having another color ink;

a shiftable stain preventing member structured to shield all but at least one type face character to be printed provided on said print wheels in the axial direction of the shaft;

means for shifting said stain preventing member reciprocally in the axial direction a distance equal to the pitch of adjacent type faces; and hammer means for pressing the at least one type face character to be printed against a print medium.

2. A printing apparatus according to claim 1, wherein the level of said stain preventing belt is approximately equal to the level of type faces of said plurality of print wheels.

3. A printing apparatus according to the claim 1, wherein the width of said stain preventing belt is smaller than that of each character of type face on said plurality of wheels.

4. A printing apparatus according to the claim 1, wherein said stain preventing belt is provided with type faces of a smaller size than those on said print wheels.

5. A printing apparatus comprising:

an ink roller;

a type drum disposed adjacent to and adapted to receive ink from said ink roller, said drum having a plurality of type face elements circumferentially disposed thereon;

a stain preventing member disposed adjacent to said type drum;

hammers disposed adjacent to said stain preventing member for causing selected type face elements to press against a print medium and the remaining type face members to contact said stain preventing member; and ink diffusion preventing means associated with said stain preventing member for preventing ink from diffusing from said stain preventing member to the print medium, said means including superposed plural plate members of different sizes, the smaller plate members facing said type drum and the larger plate member receiving excess ink from the smaller plate members.

6. A printing apparatus comprising:

a rotary type drum having sets of type faces circumferentially disposed thereon and rotatable to present selected type faces set in a printing position;

means for supplying ink to said type faces;

printing means for transferring the ink on the type faces in the printing position to a recording medium;

a stain preventing member disposed between said type drum and said recording medium for preventing the ink from alternate type faces from being transferred to the recording medium, said stain preventing member having a plate-like shape arranged to shield aligned alternate type faces of said type drum in printing position; and means for shifting said stain preventing member a distance equal to the pitch of said type faces in a direction parallel with the longitudinal axis of said type drum to permit printing of a line.

7. A printing apparatus according to claim 6, further comprising means for supplying said type drum with different colors of ink on the surface thereof; and a stain preventing belt set at the same level as that of the type faces on said type drum between different color printing portions of said drum, for preventing undesirable ink from said type drum from being transferred to the recording medium.

8. A printing apparatus according to claim 7, wherein the width of said stain preventing belt is smaller than that of each digit of type face on said type drum.

9. A printing apparatus according to claim 7, wherein said stain preventing belt is provided with type faces.

10. A printing apparatus according to claim 6, wherein said stain preventing member is provided with an ink diffusion preventing mechanism for collecting the ink at a specified location to prevent undesirable ink from said type drum from being diffused and transferred to the recording medium.

11. A printing apparatus according to claim 10, wherein said ink diffusion preventing mechanism includes superposed plural plate members of different sizes.

12. A printing apparatus according to claim 10, wherein said mechanism is formed with a shouldered cross sectional shape.

13. A printing apparatus according to claim 10, wherein said mechanism is formed with an ink draining groove.

14. A printing apparatus according to claim 10, wherein said mechanism includes a diffusion preventing layer facing said type drum.

* * * * *

UNITED STATES PATENT AND TRADEMARK OFFICE

CERTIFICATE OF CORRECTION

PATENT NO. : 4,463,672

DATED : August 7, 1984

INVENTOR(S) : MINEO NOZAKI, ET AL.

It is certified that error appears in the above-identified patent and that said Letters Patent is hereby corrected as shown below:

Column 1, line 53, delete "An" and change "another" to --Another--.

Column 2, line 13, delete "an";
line 15, delete "a" (second occurrence);
line 18, delete "a" (second occurrence);
line 27, delete "a";
line 34, delete "a" (second occurrence);
line 37, delete "a" (second occurrence);
line 41, delete "a" (second occurrence).

Column 4, line 6, delete "an".

Column 5, line 44, change "a" to --the--.

Column 7, line 68, after "roller" insert --;--.

Signed and Sealed this

Thirtieth Day of April 1985

[SEAL]

*Attest:*

DONALD J. QUIGG

*Attesting Officer* *Acting Commissioner of Patents and Trademarks*